US005467815A

United States Patent [19]

Haumann et al.

[11] Patent Number: 5,467,815

[45] Date of Patent: Nov. 21, 1995

[54] APPARATUS FOR IMPINGEMENT COOLING

[75] Inventors: Jurgen Haumann, Rekingen; Alfred Knopfli, Othmarsingen; Thomas Sattelmayer, Mandach; Rudolf Tresch, Seon, all of Switzerland

[73] Assignee: ABB Research Ltd., Switzerland

[21] Appl. No.: 174,351

[22] Filed: Dec. 28, 1993

[30] Foreign Application Priority Data

Dec. 28, 1992 [DE] Germany ..... 42 44 302.4
Dec. 28, 1992 [DE] Germany ..... 42 44 303.2

[51] Int. Cl.[6] ..... F28F 13/12

[52] U.S. Cl. ..... 165/109.1; 165/168; 165/908

[58] Field of Search ..... 165/109.1, 164, 165/168, 908; 60/752, 754

[56] References Cited

U.S. PATENT DOCUMENTS

| | | | |
|---|---|---|---|
| 2,555,965 | 6/1951 | Garber | 60/39.32 |
| 3,205,147 | 9/1965 | Foure et al. | 165/109.1 |
| 4,573,865 | 3/1986 | Hsia et al. | 415/115 |
| 4,800,718 | 1/1989 | Zimmerman | 60/264 |

FOREIGN PATENT DOCUMENTS

| | | | |
|---|---|---|---|
| 2309715 | 11/1976 | France . | |
| 1291556 | 3/1969 | Germany . | |
| 2408818 | 9/1974 | Germany . | |
| 2550100 | 5/1976 | Germany . | |
| 3229653A1 | 2/1984 | Germany . | |
| 547996 | 4/1974 | Switzerland . | |
| 510634 | 4/1976 | U.S.S.R. | 165/908 |
| 1163127 | 6/1985 | U.S.S.R. | 165/908 |
| 1481586 | 5/1989 | U.S.S.R. | 165/908 |

*Primary Examiner*—Leonard R. Leo
*Attorney, Agent, or Firm*—Burns, Doane, Swecker & Mathis

[57] ABSTRACT

In an apparatus for impingement cooling, in which a cooling surface and a cover surface are disposed parallel to one another, trapezoidal profiles that are open respectively on the narrow side and connected to one another at a constant distance from the cooling surface are disposed crosswise to the flow direction of the cooling air. A side of the trapezoid facing the cooling surface is provided with at least one row of perforations and forms a gap of a constant height with the cooling surface. Open sides of the trapezoid located opposite the cover surface form feed openings for the cooling air, and open sides of the trapezoids located opposite the cooling surface form overflow openings. The feed opening is much larger than the cross-section of a perforation. The cross-section of the return flow conduit is much larger than the overflow opening, and this opening is, in turn, much larger than the cross-section of the gap.

4 Claims, 3 Drawing Sheets

APPARATUS FOR IMPINGEMENT COOLING

FIELD OF THE INVENTION

The invention relates to an apparatus for impingement cooling a surface that can be used in numerous areas of technology, such as to cool the wall of a combustion chamber.

BACKGROUND OF THE INVENTION conventional impingement cooling systems comprise a perforated sheet metal plate disposed parallel to the surface to be cooled. Cooling air exits bores in the sheet metal plate as a series of free jets and impacts the cooling surface, and must subsequently be further transported through the gap formed by the perforated sheet metal plate and the cooling surface. The result of this is a flow transverse to the free jets. However, as the cross-flow speed increases, the deflection of the free jets increases, significantly reducing their cooling effect.

A further decrease in the cooling effect occurs when the air is heated in an uncontrollable manner from the time the cooling air enters until it exits the bores.

Applicant is aware of a gas turbine combustion chamber with impingement cooling in which the height of the cooling conduit continuously increases in the direction of the cross-flow, corresponding to the supply of cooling air, and small tubes are disposed on the perforations of the perforated sheet metal plate in such a manner that the impingement air impinges vertically upon the impingement surface, wherein the height of the small tubes increases in the cross-flow direction such that the distance of the small tubes from the impingement surface is constant over the entire length of the cooling conduit. Because of this, a constant cross-flow speed and a more uniform cooling effect are achieved. However, with this device it is not possible to completely suppress the cross-flow. But this is not desirable, because in this cooling system the cross-flow is necessary for transporting air.

OBJECT AND SUMMARY OF THE INVENTION

The invention attempts to avoid all of these disadvantages. The object of the invention is to create a device for impingement cooling in which the undesirable cross-flow is avoided and a premature heating of the cooling air is prevented.

This is achieved in accordance with the invention in that, in a device for impingement cooling a cooling surface, wherein the cooling surface and the covering surface are disposed parallel to one another, trapezoidal profiles that are open respectively on the narrow side and connected to one another at a constant distance from the cooling surface are disposed crosswise to the flow direction of the cooling air. The side of the trapezoid facing the cooling surface is provided with at least one row of perforations, and forms a gap of a constant height with the cooling surface. The open sides of the trapezoid located opposite the cooling surface form the overflow surfaces. The space between the trapezoids provided with perforations forms the trapezoidal return flow conduit. The feed surface is much larger than the cross-section of a perforation, and the cross-section of the return flow conduit is much larger than the overflow surface, and this surface is in turn much larger than the cross-section of the gap between the cooling surface and the sides of the trapezoid provided with perforations.

The advantages of the invention are seen in that, among other things, with the impingement cooling concept of the invention an undesirable cross-flow of the cooling air is prevented. By means of this, the effectiveness of the cooling is greatly improved.

It is useful when the trapezoidal profiles have a double-layered wall, which prevents a premature heating of the cooling air.

It is further advantageous when the trapezoidal profiles have a tapering shape in the flow direction of the secondary air.

Moreover, it is advantageous when at least two trapezoidal profiles are disposed one behind the other in the flow direction of the cooling air in the form of a cascade circuit. In this case the available blowing pressure is used more effectively for cooling.

The invention is described below by way of an exemplary embodiment with reference to the drawing.

BRIEF DESCRIPTION OF THE DRAWING

The features and advantages of the present invention are well understood by reading the following detailed description in conjunction with the drawings in which like numerals indicate similar elements and in which.

DETAILED DESCRIPTION OF THE PREFERRED EMBODIMENT

Figure 1:
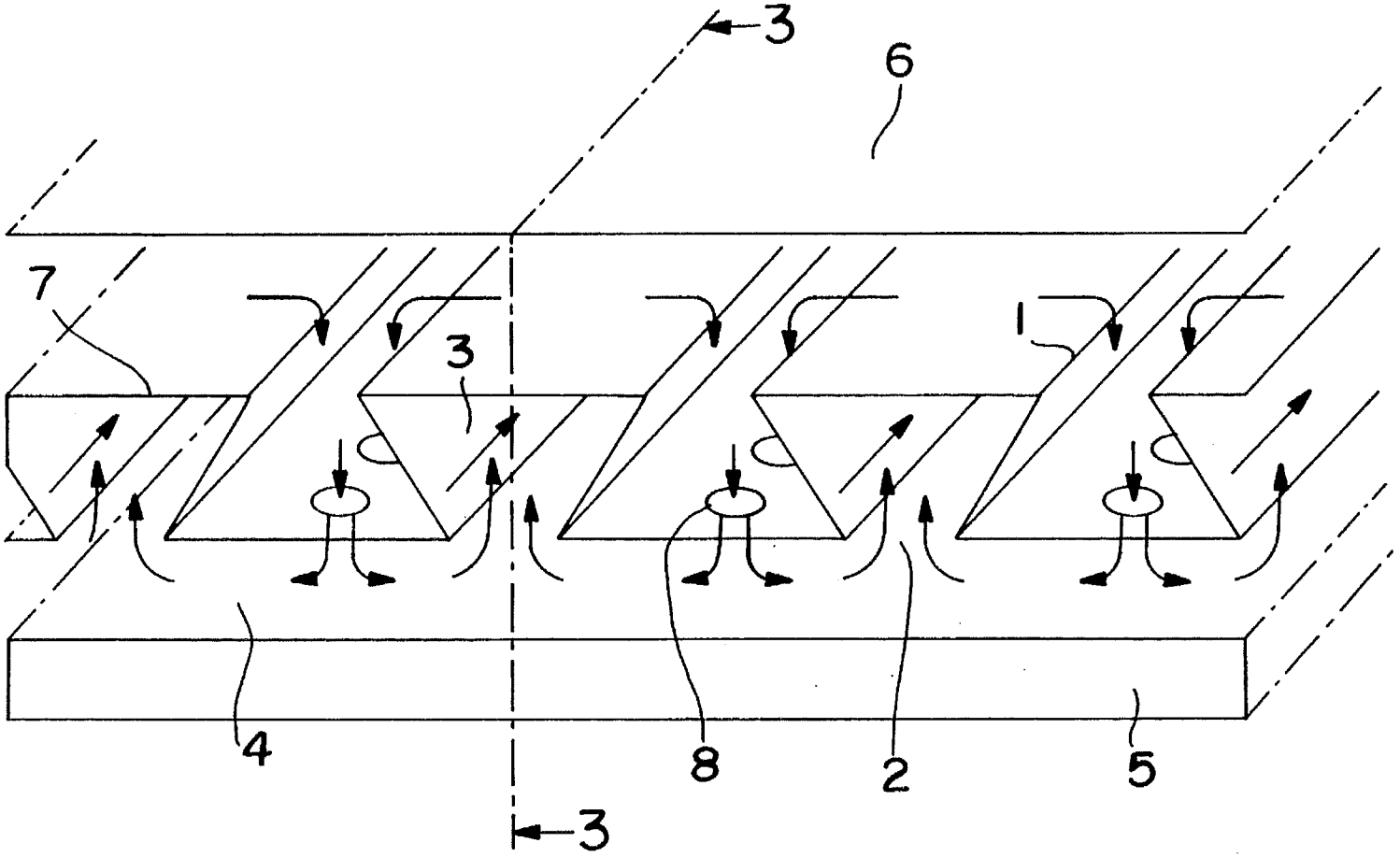
FIG. 1 is a schematic perspective view of trapezoidal profiles between a cooling surface and a covering surface according to an embodiment of the present invention.

A wall of a combustion chamber is cooled in accordance with the invention. As seen in FIG. 1, between the cooling surface 5, in this case representing the inside wall of the combustion chamber, and the cover surface 6, trapezoidal profiles 7 connected to one another and open respectively on the narrow side are disposed at a constant distance over the cooling surface 5. The trapezoidal profiles 7 form trapezoidal shaped flow channels 3, 9 arranged crosswise to the flow direction of the cooling air. The sides of the trapezoidal profiles 7 adjacent to the cooling surface 5 are provided with perforations 8, and are spaced from the cooling surface to form a gap 4 of a constant height with the cooling surface 5. The open sides of the trapezoid channels located adjacent to the cover surface 6 are the feed openings 1 for the cooling air, while the open sides of the trapezoids 7 located adjacent to the cooling surface 5 represent the overflow openings 2. A return-flow conduit 3 is open to the cooling surface 5 and alternates with a supply flow conduit 9, that includes the trapezoid profile 7 provided with the perforations 8.

The trapezoidal profiles 7 can be welded together or be comprised of an appropriately bent piece of sheet metal.

The cooling air enters the supply conduit 9 through the feed opening 1 located adjacent to the cover surface 6, and exits through the perforations 8 to impingement upon the cooling surface 5. The heat carrying air then flows through the overflow openings, that is, the gaps between the profiles adjacent to the cooling surface 5, into the trapezoidal shaped return-flow conduits 3 without impairing the cooling effect of the air exiting the adjacent trapezoidal profiles, because the cross-flow to adjacent free jets in the gap 4 is prevented.

In this case, the cross-section of the various conduits must be selected such that the air can take the desired, above-described flow course unimpaired, that is, the feed flow opening 1 must be much larger than the cross-section of the perforation 8, the cross-section of the return-flow conduit 3 must be much larger than the overflow opening 2, and the overflow opening 2 must in turn be much larger than the cross-section of the gap 4. Therefore, $$A_1 >> A_8$$

$$A_3 >> A_2 >> A_4.$$

Figure 2:
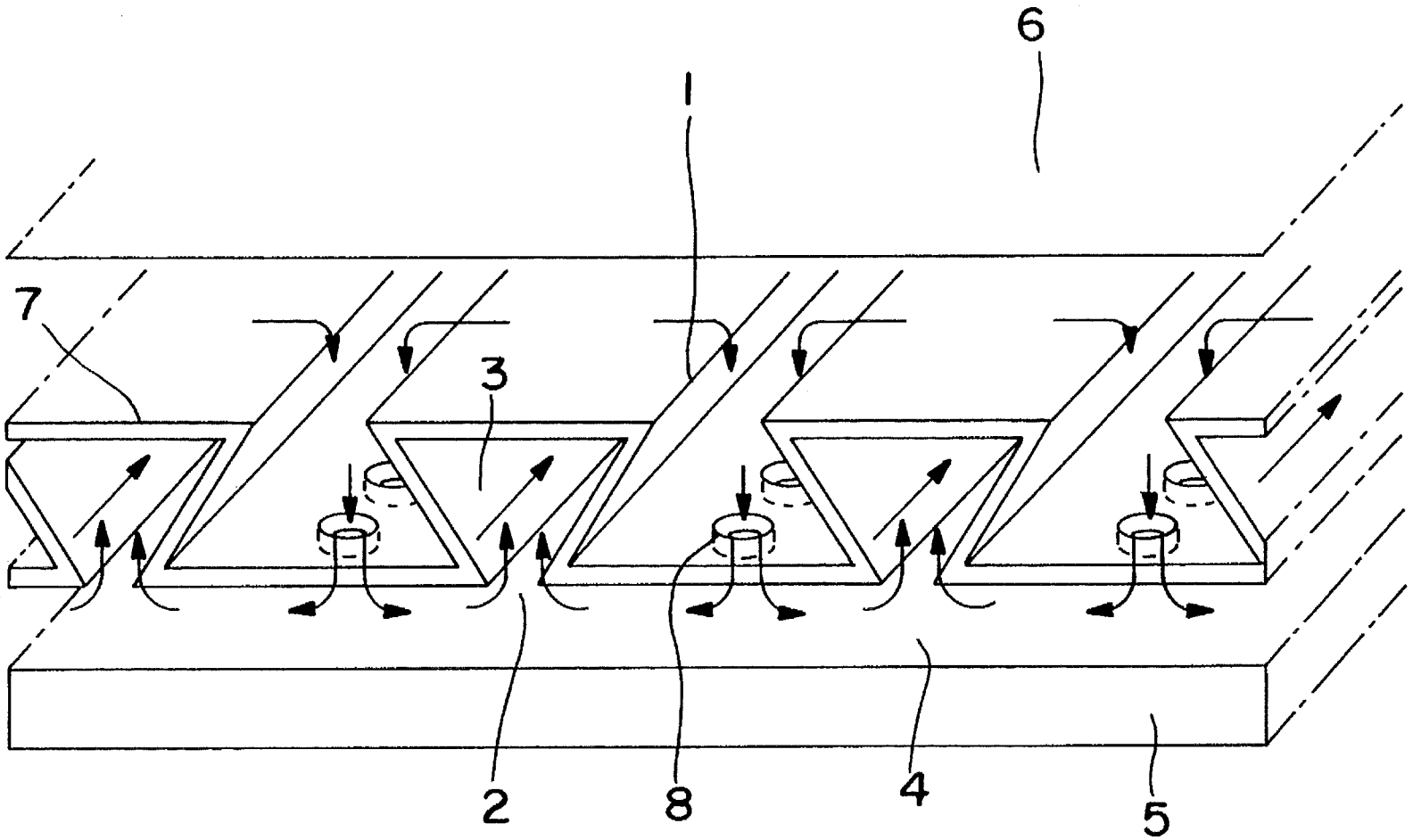
FIG. 2 is a schematic perspective view of trapezoidal profiles having double-shelled walls between a cooling surface and a covering surface according to an embodiment of the present invention.

In the impingement cooling system shown in the drawing figure, the cooling surface 5 has a relatively large heat transfer surface. Because of this, the cooling air is heated to a great extent by the return flow before it exits the perforations 8. The cooling air impinges with an increased temperature upon the cooling surface 5, causing the cooling performance of the system to decrease. An insulation between the flow-guiding conduits remedies this effect. It is advantageous in this case when the trapezoidal profiles comprise a double-layered wall as seen in FIG. 2. The outer wall acts as a radiation shield, while the air gap between the inside and outside walls prevents heat conduct, because only stationary air is located between the two walls.

Figure 3:
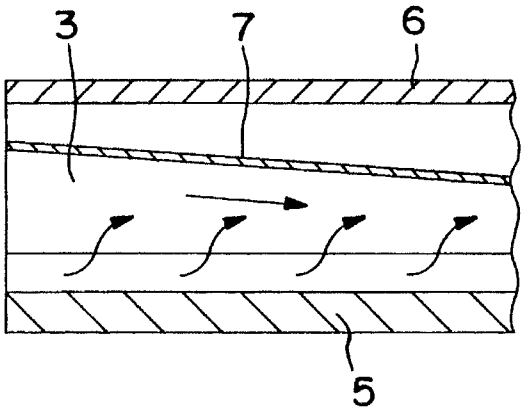
FIG. 3 is a cross-sectional view taken at section 3—3 of FIG. 1.

It is advantageous when the trapezoidal profiles have a tapering shape in the flow direction of the secondary air as seen in FIG. 3.

Figure 4:
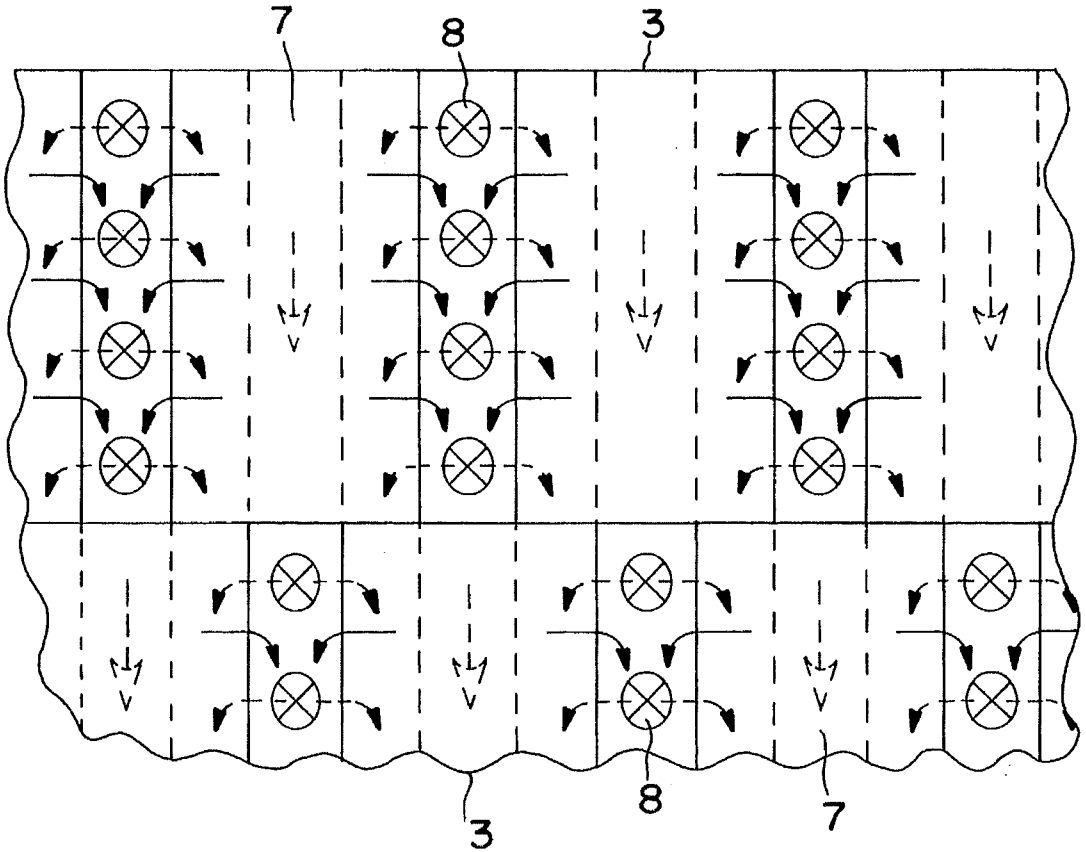
FIG. 4 is a schematic view of two trapezoidal profiles according to the present invention, arranged consecutively relative to each other, and showing secondary air flow through the profiles.

In a further exemplary embodiment, as seen in FIG. 4, the trapezoidal profiles are disposed one behind the other in the flow direction in the form of a cascade circuit. Because of this, an additional, significant improvement in the cooling performance is attained.

While this invention has been illustrated and described in accordance with a preferred embodiment, it is recognized that variations and changes may be made therein without departing from the invention as set forth in the claims.

What is claimed is:

1. An apparatus for impingement cooling a cooling surface, in which a cooling surface and a cover surface are disposed parallel to one another, comprising trapezoidal profiles that are open respectively on a narrow side and connected to one another at a constant distance from the cooling surface and are disposed crosswise to a flow direction of cooling air, wherein a side of the trapezoidal profiles facing the cooling surface is provided with at least one row of perforations, and defines, with the cooling surface, a gap having a constant height, and open sides of the trapezoidal profiles located opposite the cover surface define overflow openings, a space between the trapezoidal profiles provided with perforations defines a trapezoidal return flow conduit, a feed opening is larger than a cross-section of the perforations, a cross-section of the return flow conduit is larger than the overflow openings, and the overflow openings are larger than a cross-section of the gap between the cooling surface and the sides of the trapezoidal profiles provided with the perforations.

2. The apparatus as claimed in claim 1, wherein the trapezoidal profiles comprise a double-layered wall.

3. The apparatus as claimed in claim 1, wherein the trapezoidal profiles have a tapering shape in a flow direction of secondary air.

4. The apparatus as claimed in claim 1, wherein at least two trapezoidal profiles are disposed one behind the other in the flow direction of the cooling air and form a cascade circuit.

* * * * *